US009636599B2

(12) United States Patent
Cannon et al.

(10) Patent No.: US 9,636,599 B2
(45) Date of Patent: May 2, 2017

(54) SMART DEVICE CONTROLLED TOY

(71) Applicant: Mattel, Inc., El Segundo, CA (US)

(72) Inventors: Bruce Cannon, El Segundo, CA (US); Justin Rigling, Salem, OR (US); Paul Briskey, Salem, OR (US); Eric Stutzenberger, Salem, OR (US)

(73) Assignee: MATTEL, INC., El Segundo, CA (US)

( * ) Notice: Subject to any disclaimer, the term of this patent is extended or adjusted under 35 U.S.C. 154(b) by 196 days.

(21) Appl. No.: 14/749,080

(22) Filed: Jun. 24, 2015

(65) Prior Publication Data

US 2015/0375130 A1 Dec. 31, 2015

Related U.S. Application Data

(60) Provisional application No. 62/016,751, filed on Jun. 25, 2014.

(51) Int. Cl.
*A63F 9/00* (2006.01)
*A63H 30/04* (2006.01)

(52) U.S. Cl.
CPC ..... *A63H 30/04* (2013.01)

(58) Field of Classification Search
None
See application file for complete search history.

(56) References Cited

U.S. PATENT DOCUMENTS 3,095,653 A 7/1963 Corrigan
3,308,577 A 3/1967 Holt
3,737,566 A 6/1973 Baer
3,849,931 A 11/1974 Gulley, Jr.
3,961,441 A 6/1976 Sato
3,993,861 A 11/1976 Baer
4,086,724 A 5/1978 McCaslin
4,165,581 A 8/1979 Wolf
4,201,012 A 5/1980 Marshall
4,206,557 A 6/1980 Swinton
4,310,987 A 1/1982 Chieffo
4,329,684 A 5/1982 Monteath
4,496,158 A 1/1985 Baer
4,599,644 A 7/1986 Fischer
4,613,904 A 9/1986 Lurie
4,654,700 A 3/1987 Baer
4,662,854 A 5/1987 Fang
4,807,031 A 2/1989 Broughton
4,815,733 A 3/1989 Yokoi
4,828,525 A 5/1989 Okano
4,865,575 A 9/1989 Rosenthal
4,920,503 A 4/1990 Cook
4,931,028 A 6/1990 Jaeger
(Continued)

*Primary Examiner* — Seng H Lim
(74) *Attorney, Agent, or Firm* — Foley & Lardner LLP

(57) ABSTRACT

A toy is controlled by a smart device with wireless communication network connection capability, a display screen and programmed to generate optical control signals transmitted through the screen. The toy includes a main body, a control circuit, a holder configured to receive and releasably hold the smart device, and an optical signal receiver supported facing the display screen of the smart device in the holder and operably connected with the control circuit. The control circuit responds to optical control signals transmitted through the screen and detected by the optical signal receiver to control at least one operation of the toy.

20 Claims, 8 Drawing Sheets

(56) References Cited

U.S. PATENT DOCUMENTS

| | | | | |
|---|---|---|---|---|
| 4,956,639 | A | 9/1990 | Uemura | |
| 4,987,349 | A | 1/1991 | Nakamura | |
| 5,013,276 | A | 5/1991 | Garfinkel | |
| 5,127,658 | A | 7/1992 | Openiano | |
| 5,158,492 | A | 10/1992 | Rudell | |
| 5,195,920 | A | 3/1993 | Collier | |
| 5,630,743 | A | 5/1997 | Shi | |
| 5,741,185 | A | 4/1998 | Kwan | |
| 5,847,854 | A | 12/1998 | Benson, Jr. | |
| 5,873,765 | A | 2/1999 | Rifkin | |
| 6,028,533 | A | 2/2000 | Javors | |
| 6,071,166 | A | 6/2000 | Lebensfeld | |
| 6,250,987 | B1 | 6/2001 | Choi | |
| 6,254,486 | B1 | 7/2001 | Mathieu | |
| 6,309,275 | B1 | 10/2001 | Fong | |
| 6,380,844 | B2 | 4/2002 | Pelekis | |
| 6,390,883 | B1 | 5/2002 | Choi | |
| 6,461,218 | B1 | 10/2002 | Mullaney | |
| 6,551,165 | B2 | 4/2003 | Smirnov | |
| 6,672,934 | B2 | 1/2004 | Hornsby | |
| 6,682,387 | B2 | 1/2004 | Choi | |
| 6,780,077 | B2 | 8/2004 | Baumgartner | |
| 6,814,643 | B1 | 11/2004 | Dooley | |
| 6,840,839 | B2 | 1/2005 | Rehkemper | |
| 6,881,122 | B2 | 4/2005 | Bloch | |
| 6,893,320 | B2 | 5/2005 | Caiozza | |
| 6,907,029 | B2 | 6/2005 | Brabrand | |
| 6,992,593 | B2 | 1/2006 | Javors | |
| 7,040,951 | B2 | 5/2006 | Hornsby | |
| 7,172,488 | B2 | 2/2007 | Moll | |
| 7,662,017 | B2 | 2/2010 | Moll | |
| 7,695,338 | B2 | 4/2010 | Dooley | |
| 7,704,119 | B2 | 4/2010 | Evans | |
| 7,758,399 | B2 | 7/2010 | Weiss | |
| 7,905,576 | B2 | 3/2011 | Kusunoki | |
| 8,137,152 | B2 | 3/2012 | Tsai | |
| 8,152,589 | B2 | 4/2012 | Bowen | |
| 8,162,715 | B2 | 4/2012 | Mayer | |
| 8,203,423 | B2 | 6/2012 | Ozolins | |
| 8,588,972 | B2 * | 11/2013 | Fung | B25J 11/003 446/454 |
| 2002/0142701 | A1 | 10/2002 | Rosenberg | |
| 2004/0018800 | A1 | 1/2004 | Caiozza | |
| 2004/0209545 | A1 | 10/2004 | Rudell | |
| 2007/0060018 | A1 | 3/2007 | Chou | |
| 2008/0108273 | A1 | 5/2008 | Alden | |
| 2008/0108277 | A1 | 5/2008 | Nunez Serrano | |
| 2010/0167625 | A1 | 7/2010 | Conway | |
| 2011/0144778 | A1 | 6/2011 | Fung | |
| 2011/0183577 | A1 | 7/2011 | Chen | |
| 2011/0288684 | A1 * | 11/2011 | Farlow | B25J 11/009 700/264 |
| 2011/0320314 | A1 | 12/2011 | Brown | |
| 2012/0028535 | A1 | 2/2012 | Sivan | |
| 2012/0077411 | A1 | 3/2012 | Amireh | |
| 2012/0115394 | A1 | 5/2012 | Sivan | |
| 2012/0122367 | A1 | 5/2012 | Sivan | |
| 2012/0225645 | A1 | 9/2012 | Sivan | |
| 2012/0302129 | A1 | 11/2012 | Persaud | |
| 2013/0109272 | A1 | 5/2013 | Rindlisbacher | |
| 2014/0297067 | A1 * | 10/2014 | Malay | G01C 9/005 701/4 |
| 2015/0303862 | A1 * | 10/2015 | Lo | G05B 15/02 700/287 |
| 2015/0336276 | A1 * | 11/2015 | Song | B25J 11/001 700/253 |

* cited by examiner

SMART DEVICE CONTROLLED TOY

REFERENCE TO RELATED APPLICATION

This application claims priority to Provisional U.S. Patent Application Ser. No. 62/016,751 filed Jun. 25, 2014 and incorporated by reference herein in its entirety.

BACKGROUND OF THE INVENTION

The present invention relates to remotely controlled toys and, in particular, toys remotely controlled with smart devices.

SUMMARY OF THE INVENTION

In one aspect, the invention is a toy configured to be controlled by a hand portable smart device having wireless communication network connection capability, a display screen and programming to generate optical control signals transmitted through the display screen, the toy comprising: a main body; a control circuit supported from the main body; a holder supported from the main body and configured to receive and releasably support the smart device on the main body; and an optical signal receiver supported from the main body facing the display screen of the smart device held in the holder and operably connected with the control circuit; the control circuit being configured to respond to optical control signals transmitted through the display screen of the smart device and detected by the optical signal receiver to control at least some operation of the toy.

In another aspect, the invention also includes a method of controlling an electrically operated toy having a main body, a control circuit, an optical signal receiver operably connected with the control circuit and supported from the main body, and a holder supported from the main body and configured to receive and releasably support a smart device having wireless communication network connection capability and further having a display screen juxtaposed to the optical receiver, comprising the steps of: releasably receiving in the holder, the hand portable smart device with the display screen positioned facing the optical signal receiver; detecting with the optical receiver, an optical control signal from the display screen of the smart device; and operating the toy, with the control circuit responding to the optical control signal detected through the optical receiver.

BRIEF DESCRIPTION OF THE DRAWINGS

The following detailed description of embodiments of the invention will be better understood when read in conjunction with the appended drawings. For the purpose of illustrating the invention, there is shown in the drawings one embodiment. It should be understood, however, that the invention is not limited to the precise arrangements and instrumentalities shown.

DETAILED DESCRIPTION OF THE INVENTION

Figure 1:
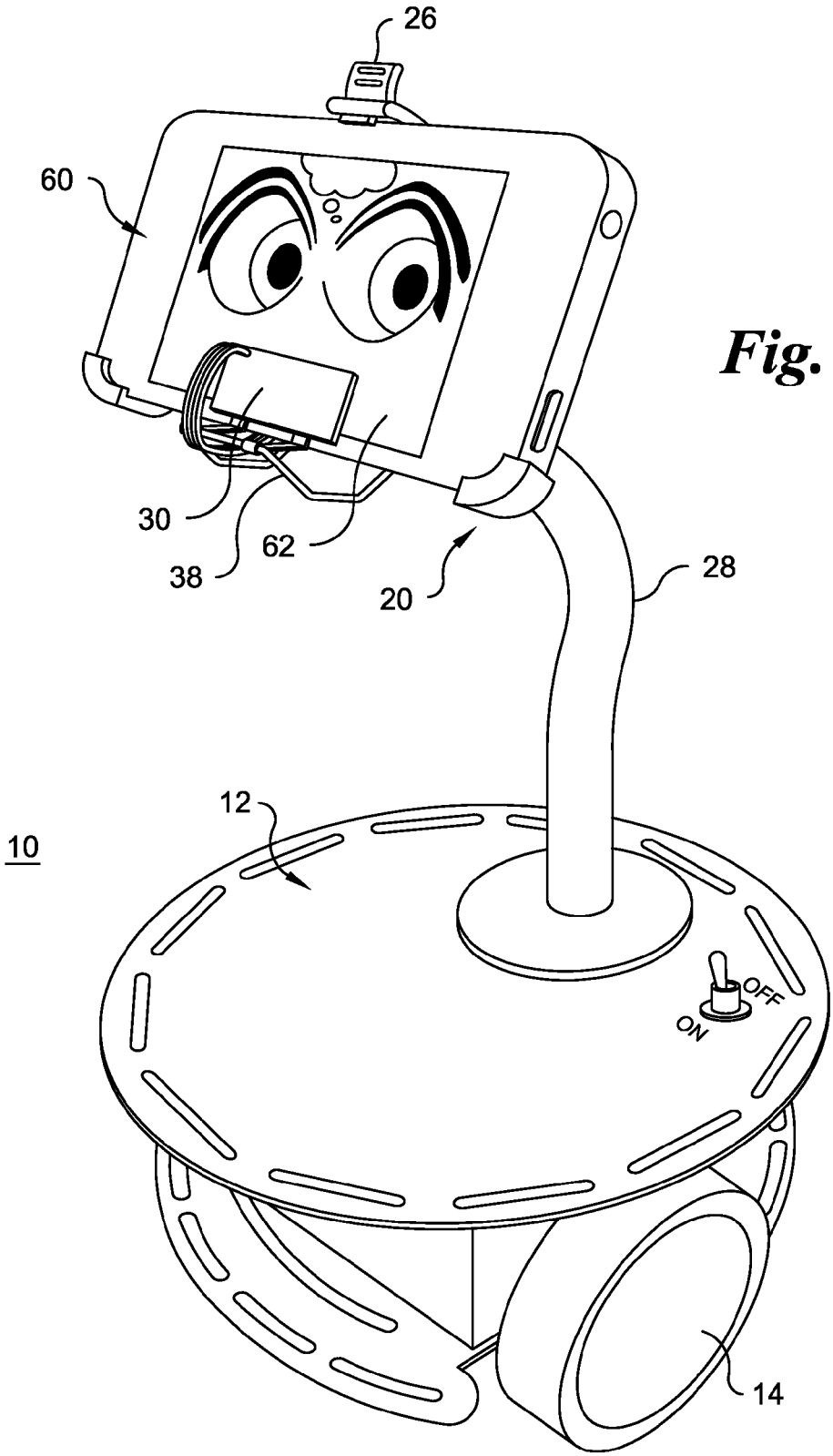
FIG. 1 is a perspective view of one embodiment toy of the present invention in the form of a robot/vehicle.
Figure 2:
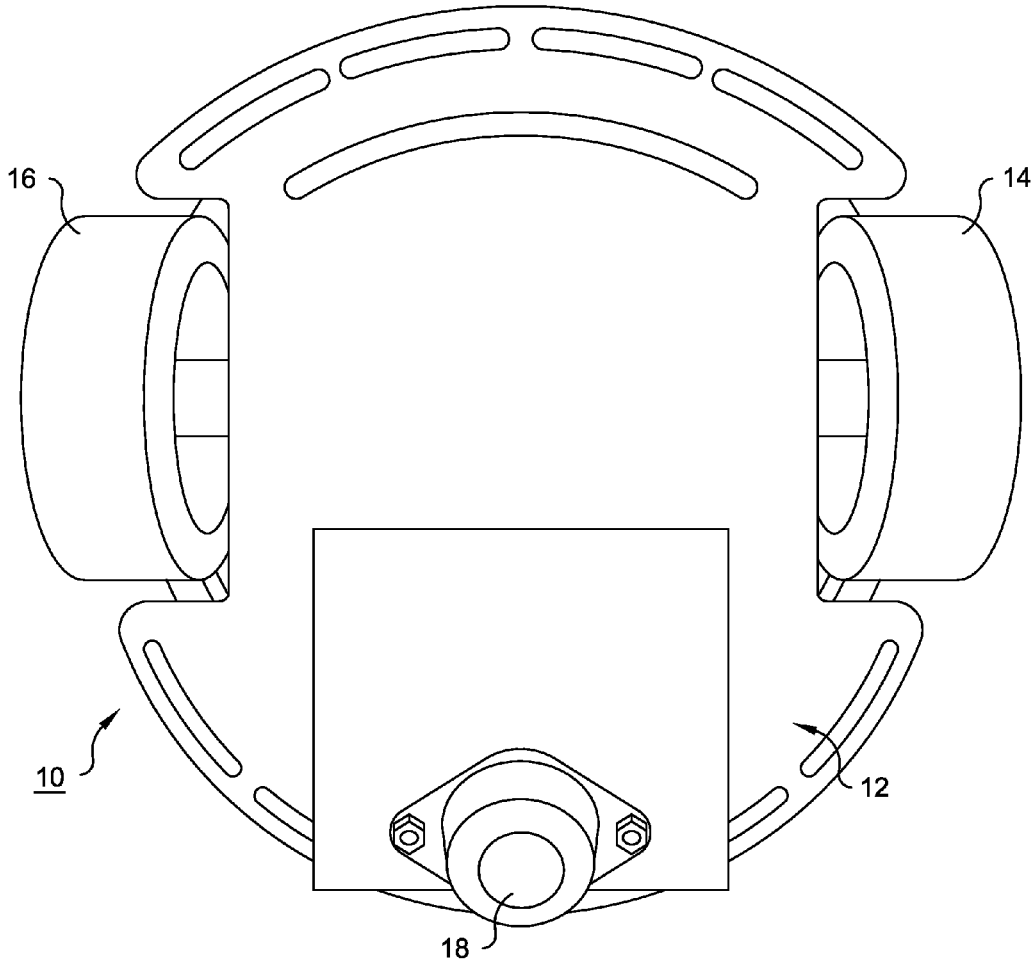
FIG. 2 is a bottom plan view of the toy of FIG. 1.
Figure 3:
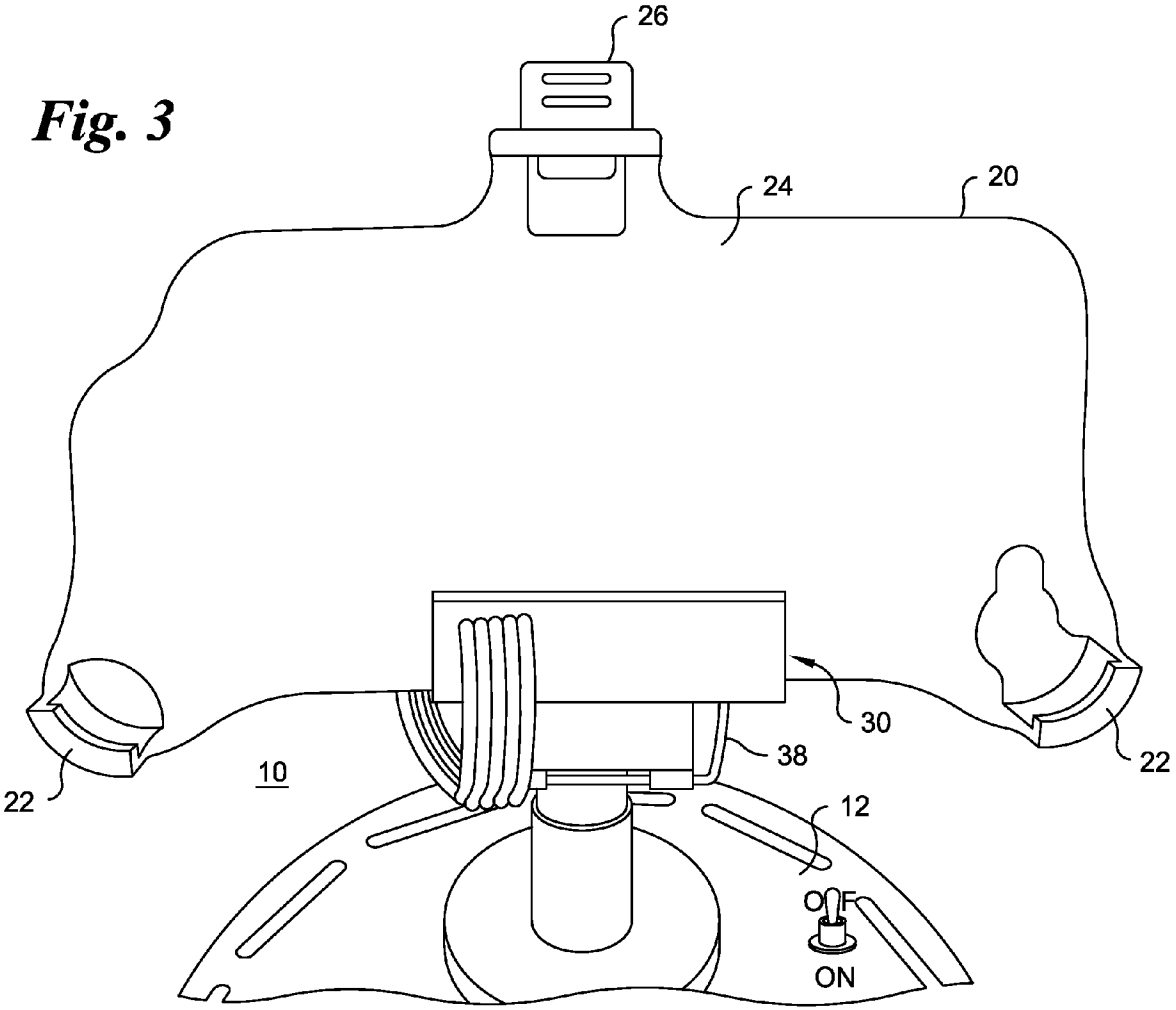
FIG. 3 is a forward looking view from the main body of the toy to the smart device holder.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the stated component and designated parts thereof. The terminology includes the words above specifically mentioned, derivatives thereof and words of similar import.

FIG. 1 depicts a first embodiment of the invention, a toy 10 configured to be controlled by a hand portable smart device 60 such as a smart phone or tablet having wireless communication network connection capability. The smart device 60 has a display screen 62 and is programmed by means of a software application ("app") to generate at least optical control signals transmitted through the display screen 62 to the toy 10.

The toy 10 comprises a main body 12 with first and second propulsion wheels 14, 16, respectively. One or more additional wheels or supports may be provided for stability and/or amusement. In the toy 10, a ball bearing has been disclosed as a third support 18 of the main body 12 but it might equally be a castered wheel or an unpowered road wheel with some other mounting to the main body 12. Alternatively or in addition, another type of support may be provided such as a skid member or another toy component such as a creature tail acting as a skid member.

A smart device holder 20 is supported in a generally upright orientation from the main body 12. It may be supported directly from the main body by locating the receiver 20 in or on the main body, or indirectly from the main body, for example, on a stalk 28, itself supported from the main body. In this particular embodiment, the stalk 28 also mimics the "neck" for the depicted robot. The holder 20 is configured to receive and releasably hold the smart device 60 on the main body 12. One example holder 20 is depicted and includes an underlying or bottom support portion 22 in the form of a pair of lower corner stirrups (also 22) and a backing portion 24 supporting the stirrups. A top retainer 26 may be provided. While the depicted top retainer 26 is resiliently fixed on the backing portion 24, it might be adjustably mounted so as to more controllably vary the retention of the device 60 on the holder 20. One or more resiliently flexible fingers (not depicted) might be provided as the bottom support 22 or from the backing portion 24 like the depicted top retainer 26 or stirrups 22 to alternatively or additionally releasably retain the device 60 more securely than the depicted fixed stirrups 22 and top retainer 26. The disclosed holder design and mounting are not to be considered limiting as other releasable holder designs and mountings with the main body are possible.

The holder 20 further supports from the main body with the smart device 60, an optical signal receiver indicated generally at 30 facing a portion of the display screen 62 of the smart device 60 being held in the holder 20. The optical signal receiver 30 is supported on a member 38 so as to pivot away from the backing portion 24 to permit the smart device 60 to be mounted to the holder 20. Other support arrangements for the smart device and the receiver will occur to those of ordinary skill. In some embodiments like the one that is depicted, the optical signal receiver 30 is positioned to overlap only a minor portion of the display screen 62 so the remainder of the display screen remains visible on the holder 20. Observer visibility of even a portion of the smart device display screen is not required for operation of the toy 10 although it can be useful to create a virtual component of the toy as it has been done in this embodiment. The optical signal receiver 30 may be movably positioned on the holder 20 or from the stalk 28 so as to be adjusted to rest against the appropriate area of the display screen 62 and simultaneously releasably retain the smart device 60 on the holder 20. The relationship of the mounting of the holder 20 and the optical receiver 30 is such as to provide automatic alignment of the receiver 30 with the area(s) of the display screen 62 that generate optical signals.

The optical signal receiver 30 is operably connected with a control circuit 40 also supported directly or indirectly from the main body 12, and is, for example, within the main body 12 of toy 10 for protection. The control circuit 40 is configured by programming of a microprocessor based microcontroller 42 to respond to optical control signals transmitted through the display screen 62 of the smart device 60 and detected by the optical signal receiver 30 to control at least some operation of the toy 10.

According to the invention, the toy further includes at least one electrically powered component operably connected with the control circuit 40, and the control circuit is configured to operate the component to provide a humanly cognizable action in response to at least one optical control signal transmitted by the smart device 60. In the present embodiment, toy 10 has first and second propulsion wheels 14, 16, and two electrically controlled components in the form of separately controlled and electrically operated, first and second propulsion motors 54, 56. The motors are respectively operably connected with the first and second propulsion wheels 14, 16 to rotate those wheels and thereby maneuver the toy 10 (a humanly cognizable action) in response to optical control signals transmitted by the smart device 60.

Figure 5:
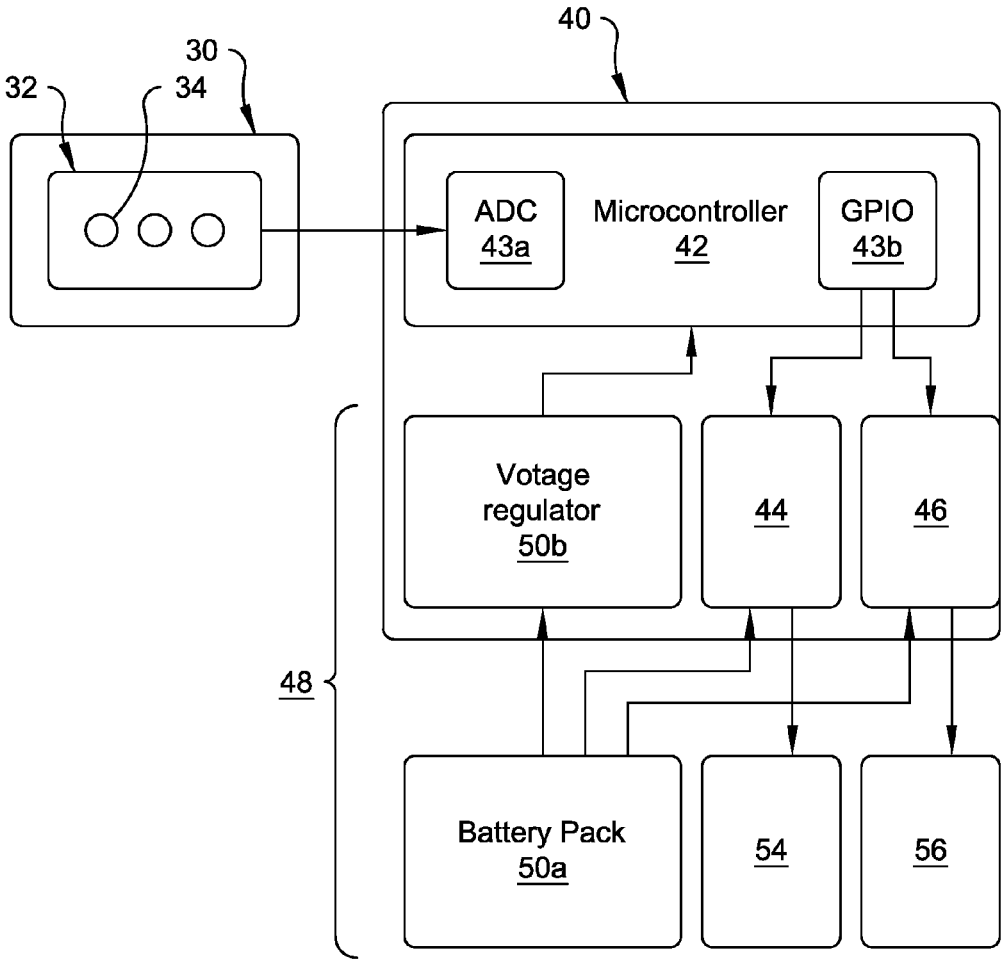
FIG. 5 is a block diagram of the electrical components of the toy.

Referring to FIG. 5, an exemplary control circuit 40 includes, as part of the microprocessor based microcontroller 42, an integral analog to digital converter (ADC) 43*a* in operable connection with the optical signal receiver 30. Of course, the ADC could be a separate component or eliminated if the receiver 30 is configured to output digital signals. However, it can be used to adapt the toy to varying smart device screen brightness outside the control of the app. In this embodiment, the microprocessor 42 also includes a General Purpose Input Output pin ("GPIO") 43*b* for at least outputting control signals to first and second motor control circuits 44, 46, which are configured as driver circuits to separately and independently supply power to each of the first and second motors 54, 56 from an electrical power supply 48 such as an array of batteries 50*a* and a voltage regulator 50*b*. Regulator 50*b* may be configured together with the remainder of the control circuit as depicted or separately from that circuit. The control circuit 40 might alternatively be configured for the microprocessor 42 to receive a digital input from a differently configured optical signal receiver 30 through the GIPO pin instead of the ADC 43*a*.

Figure 6:
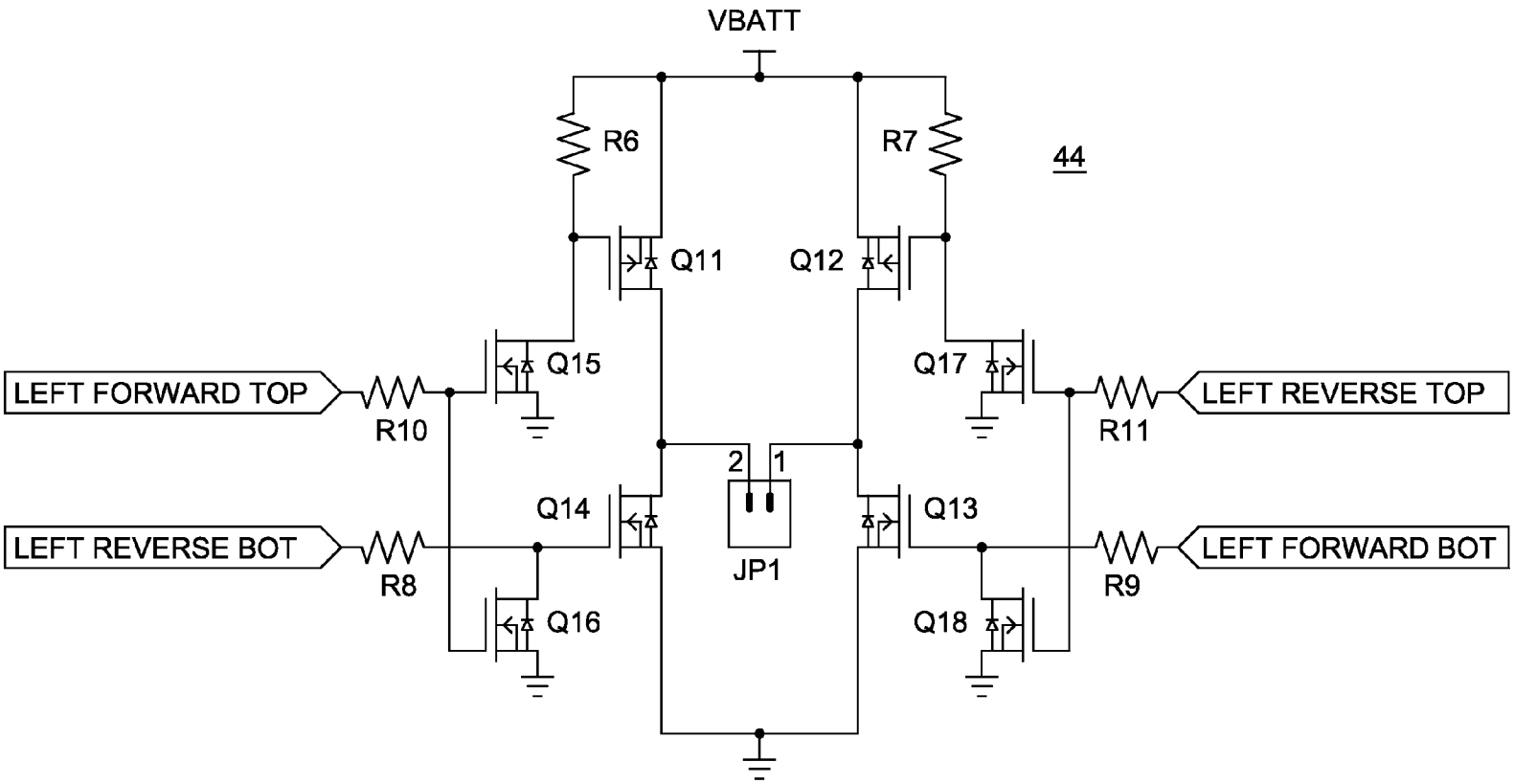
FIG. 6 depicts a suggested configuration for an exemplary motor control circuit.

One possible motor control or motor driver circuit 44, 46 implementation for "left wheel" control with eight discrete MOS-FETs is seen in FIG. 6. Each transistor is individually controlled by the microprocessor 42. Four transistors, two P Channel (Q11, Q12) and two N Channel (Q13, Q14), make up the high current H-Bridge. In order to control the P-Channel FETs from the microcontroller 42, two lower current N-Channel FETs (Q15, Q17) are used. To prevent conduction through either leg of the H-Bridge, two additional N-Channel FETs (Q16, Q18) are used to disable the bottom side FET if the top side FET is enabled. The remaining "right wheel" circuit would be similarly configured and operated.

Direction is selected by picking one of the top side FETS to be enabled constantly while the opposite leg is pulse width modulated (PWM) by the microprocessor 42 between the top and bottom side. The duty cycle of the PWM determines the speed. As a precaution against shoot-through (both top and bottom FETs on one leg conducting at same time) the microprocessor is suggestedly programmed to disable one FET before enabling the other.

Figure 4:
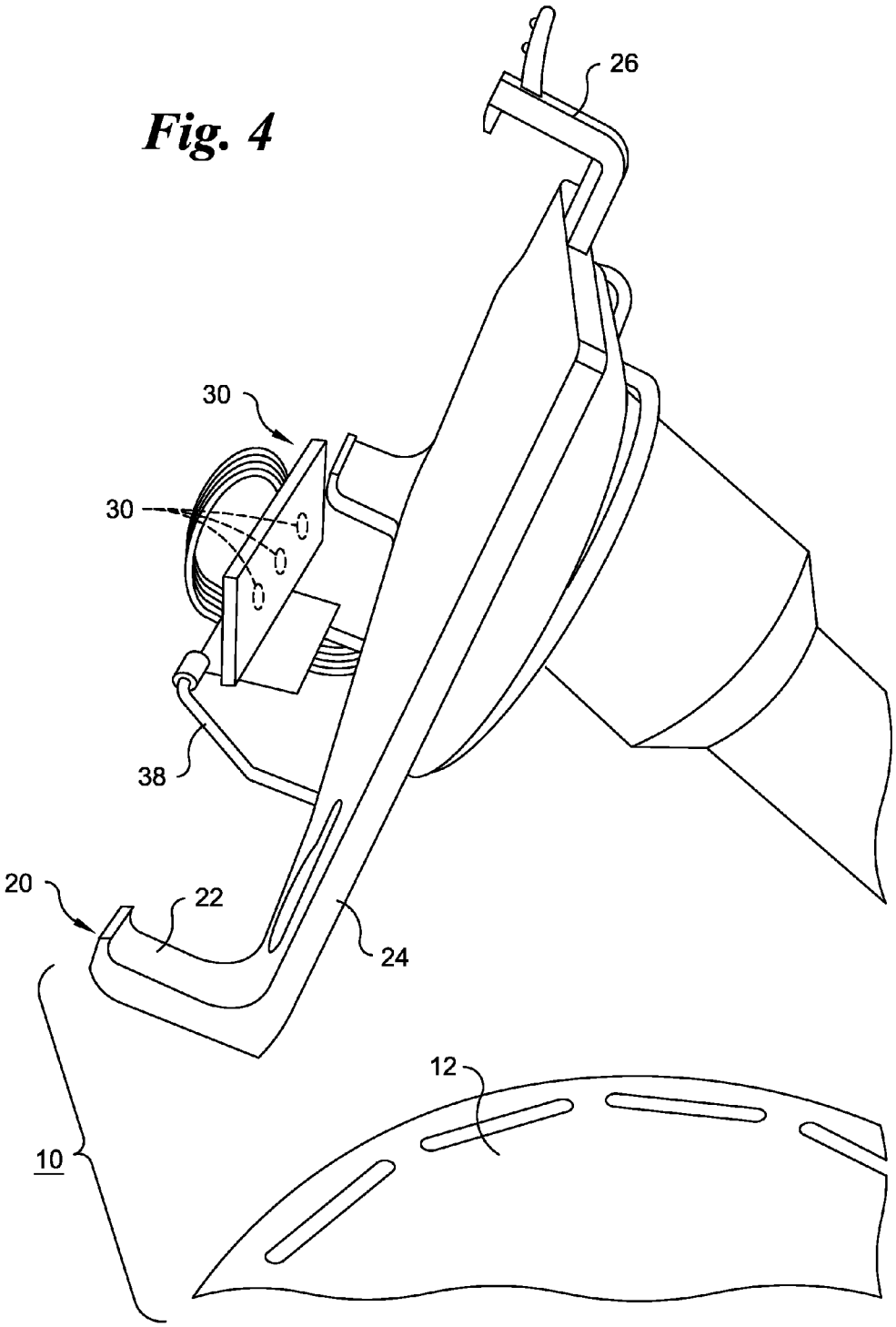
FIG. 4 is a side view of the smart device holder.
Figure 7:
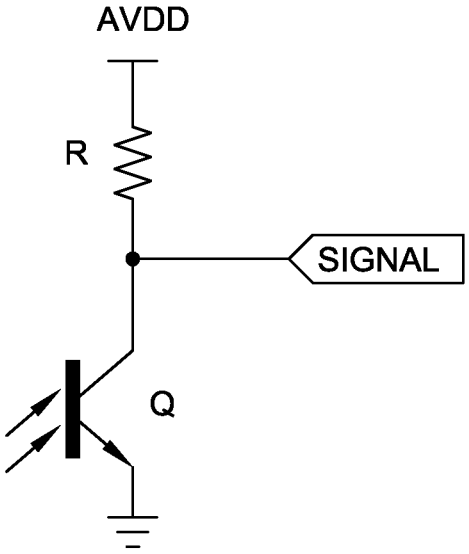
FIG. 7 depicts a suggested configuration for an exemplary photo sensor.

Referring back to FIG. 5, the optical signal receiver 30 has an array 32 of at least two or, in the embodiment being disclosed, at least three photo sensors 34, to detect binary outputs from multiple separate optical signal channels generated by the smart device 60 and outputted by the device 60 at separate but preferably juxtaposed locations on the display screen 62, each channel location being directly opposite the location of a separate one of the individual photo sensors 34 of the array 32 (see FIG. 4). FIG. 7 depicts a suggested circuit configuration of one of the photo sensors 34 of the array 32, configured as a photo transistor Q in series with a resistor R. The photo transistors Q of the array would be connected in a common emitter configuration. As indicated in FIG. 5, the photo sensor array 32 might be configured with photo diodes or still other types of optical sensors.

It will be appreciated that in the simplest types of remote control schemes, a single optical detector could detect at any given moment, either of two alternate light states, off and on, and therefore, at any given moment, could detect one of only two, single bit optical commands (off/on-0/1). Two detectors would provide the option of four different instantaneous detector state combinations (00/01/10/11) and four instantaneous optical commands. Three detectors provide the option of eight different instantaneous detector state combinations and eight different instantaneous optical commands, and so on. Six commands would provide conventional maneuver control for toy vehicles and similar maneuverable toys: forward, reverse, left turn forward and reverse and right turn forward and reverse. In addition, most remotely controlled maneuverable toys have an instant stop state as well. In an optical system of the type being discussed, one of the state combinations, for example, 0 or 00 or 000, would have to be dedicated as an instant stop command to provide that control option.

Again, in the simplest types of control schemes, these commands would be executed at a preset speed which, for conventional RC toy vehicles, is often full speed forward and half of full speed in turns and reverse. Many more commands would be needed for even modest variable speed control. In some toys, immediate, full speed or even half speed operation may not be desirable. For instance, in the depicted embodiment, the robot aspect of the vehicle might be more "realistic" if it could react with different speeds. In order to minimize the number of photo sensors 34 required in the optical signal receiver 30 and yet maximize the movement control of the toy 10 with a minimal number of commands, a relative speed change control set might be used. Instead of conventionally commanding a pair of motors to operate to go forward or backward, turn left or right at fixed speeds, the toy 10 is commanded to fractionally increase or decrease its speed or left to right motor speed difference. Each optical signal command would make an incremental change to the speeds of the two motors. No single command would make the toy 10 go forward or perform any movement or operation at full speed. A sequence of commands provided by a stream of optical control signals from the smart device would provide this type of control.

Thus, two parameters can be used to control movement of the toy 10 via relative speed: common motor speed and differential motor speed. Common motor speed is the average of the speeds of the two motors. It is positive when center of toy 10 is moving forward and negative when center of toy 10 is moving backward. It can be increased or decreased in steps. It is zero when center of toy 10 is stationary (i.e. not having any translational movement). Differential motor speed is the difference between the speeds of the two motors. Preferably, changes in differential motor speed do not change the common or average speed. As currently embodied, a Right Turn (or technically More Right) optical command would result in an increase of the left motor speed and a preferably equal decrease of the right motor speed, while a Left Turn (i.e. More Left) optical command would result in an increase of the right motor speed and equal decrease of the left motor speed, again preferably equally, with corresponding changes in the right and left propulsion wheels speeds. Of course, turning could be accomplished by changing the speed of only one motor or by changing motor speeds by different amounts. It is possible for one motor to be turning forward, while the other is turning backward. When this happens, common motor speed is less than differential motor speed.

As used herein, changing motor speeds "fractionally by equal amounts" and like terms referring to "equal" changes encompass changing speeds by equal RPM amounts (assuming wheel RPM's are being measured for feedback) from then existing RPM's, by equal fractional amounts of then existing speeds or by varying power supplied to each of the motors by equal percentages or by equal absolute amounts (e.g. by equal numbers of pulses in PWM motor control circuits). All but actual equal numbers of RPM changes may cause slight variations in the common and differential motors speeds, so minor as to be unnoticeable in most if not all situations.

In this way, four control commands can be used to incrementally or fractionally change the speed of the motors 54, 56: an INCREASE command increases the speed of both motors a predetermined fractional amount of top or maximum motor speed; a DECREASE command decreases the speed of both motors a predetermined fractional amount; a RIGHT command which increases speed of the left motor a predetermined fractional amount while decreasing speed of the right motor a predetermined amount (preferably the same fractional amount as the increase); and a LEFT command which decreases speed of the left motor a predetermined amount while increasing speed of the right motor a predetermined amount (again, preferably the same fractional amount as the increase). For example, in response to an INCREASE or DECREASE optical control signal command, the microprocessor 42 would be programmed to increase or decrease electric power supplied to both motors 54, 56 by the same percentage, suggestedly anything between 10% and 50% with 10% presently used, for desired responsive movement of a robot configured toy vehicle 10. Similarly, in response to a RIGHT (More right/Right turn) or LEFT (More Left/Left turn) optical control signal command, the microprocessor would be programmed to increase and decrease electric power supplied to opposite motors by the same percentage, suggestedly 1% or more with 2% being presently used for the robot configured vehicle 10. It will be appreciated that motor speed would be relative and most conveniently determined and controlled by power being supplied to the motor by the microprocessor 42. In this embodiment, speed control and variation is accomplished by and therefore equivalent to control and variation of electric power being supplied by the microprocessor 42 to the respective motor 54, 56 through the respective motor control or driver circuit 46 for example, through the previously mentioned pulse width modulation (PWM) of the motor control circuits 44, 46.

Here are some examples of how an optical control signal set of four different commands and corresponding binary optical signal command codes, for example, INCREASE/11, DECREASE/00, RIGHT/10, LEFT/01, would be used to maneuver the toy vehicle provided the vehicle could be made to respond to a stream of consecutive commands:

| Starting Condition | Desired resulting condition | Commands |
|---|---|---|
| Full stop | Full speed forward | 10 × INCREASE |
| Full stop | Full speed reverse | 10 × DECREASE |
| Full stop | Half speed forward | 5 × INCREASE |
| Any speed | Slight Right turn | 1 × RIGHT |
| Any Turn right | Straight | X × LEFT (X = previous RIGHTS) |
| Full stop | Spin in place | Either LEFT or RIGHT |
| Spinning in place | Spin in place faster | More LEFT or RIGHT (apply same direction) |
| Spinning in place | Forward and straight | LEFT or RIGHT to cancel differential speed and INCREASES to desired forward speed. |
| Full speed forward | Full speed reverse | 20 × DECREASE. |
| Some speed forward in straight line | Same forward speed in a straight line, but after turning to the right | 1 × RIGHT, then 1 × LEFT to cancel the motor difference |

In this system, four binary optical signal command codes are used to achieve many combinations of left and right motor speed. This command style works especially well for behaviors like line following. The feedback to follow a line could be "more left or more right". An absolute "turn right" or "turn left" command might act too severely. Also, the combination of low cost motors, gearboxes, and electronics might not be perfectly matched so that the toy 10 will drive in a straight line when both motors are commanded to the same speed. This command scheme gives the higher level control system the ability to more easily tune the system to achieve a straight line.

For the disclosed application of a robot/vehicle, step sizes of 10% for common, 2% for differential are suggested. However, the step size of these optical signal commands can be set to different values. So the common mode changes (INCREASE, DECREASE) could perform in 20-50% steps to speed up and down in fewer commands. Where more control is desired in the differential speed, the step size could be reduced to below 10%, down to even 1%. This would limit the ability of the toy 10 to quickly turn left or right, so a variable differential speed may be useful and implemented in the microprocessor 42. When the differential is small, the step size is small, as the differential increases, the step size can increase. This would enable fine control to aid driving in a straight line, while allowing the differential to be changed significantly for a sharp turn in a few commands.

If only four commands were needed, then as indicated above, only two photo sensors 34 would be required to represent the instantaneous binary optical signal codes of all four commands. However, there would be no STOP command. The null optical command signal (00) would have to be used for one of the four identified movement commands. If the microprocessor 42 of the toy 10 sampled the display 62 at a regular interval and interpreted the commands, it would always be making a change because of this control scheme design. Unless the velocity of the toy 10 were always changing, another command would be necessary that makes no changes to the motors at all. Adding a third photo sensor provides the option of four additional optical binary codes and corresponding commands to include a NO_CHANGE command which would allow the toy to remain at rest or in its current movement state.

Since the screen update rate of different smart devices is not predictable, regular sampling by the toy 10 may miss commands or sample the same command multiple times. Instead, this command scheme is designed to require a transition to a different pattern in order to execute a new command. The microprocessor 42 can be programmed to look for a transition on any of the photo sensors 34, delay responding slightly while it determines the new pattern from all of the photo sensors and finally execute the command associated with that pattern. This enables the control system to work with any screen update rate, but prevents sending the same command twice. To keep the ability to change speed at the highest rate, a REPEAT command is suggestedly added that repeats the last command sent. This allows the control system to send alternating patterns, but execute the same command consecutively.

It will be appreciated that the REPEAT and NO CHANGE command codes can be characterized as transition codes which provide necessary transitions in the stream of optical control signals generated by the smart device to separate consecutive or sequential movement control signal commands from the device for identification of such by the microprocessor 42.

With both the NO CHANGE and the REPEAT commands, the system has the ability to continuously send new optical signal patterns even when no change is desired. This allows a special STOP command to intrinsically exist as the absence of new commands within a certain period of time. The system will return all motors to zero speed if no new patterns are sampled on the photo sensors within about a predetermined period of time. Presently about 300 milliseconds is suggested. This feature provides the ability to stop the toy 10 from any combination of speeds and return it to a known condition as well as safely stop the toy 10 when the smart device 60 is removed from the holder 20, an interrupt such as a phone call transitions the device 60 to another screen, or the smart device's battery dies.

The following is a suggested three-bit binary optical control signal set and corresponding optical signal command set:

| Optical Control Signal Command | Description | Binary Optical Signal Command Code |
|---|---|---|
| NO_CHANGE | No effect on motor speeds, behaves like a heart beat | 000 |
| INCREASE | Adds 10% to both motors' speed | 001 |

-continued

| Optical Control Signal Command | Description | Binary Optical Signal Command Code |
|---|---|---|
| DECREASE | Subtracts 10% from both motors' speed | 010 |
| RIGHT | Adds 2% to Left motor, Subtracts 2% from Right motor | 011 |
| LEFT | Adds 2% to Right motor, Subtracts 2% from Left motor | 100 |
| OPTIONAL1 | (Available but not implemented) | 101 |
| OPTIONAL2 | (Available but not implemented) | 110 |
| REPEAT | Executes last command again | 111 |

As can be seen, with this optical control signal set, two optical commands, OPTIONAL1 and OPTIONAL2, are available to control other action(s). One of these two can be dedicated to an instant STOP command, if desired, with or without a timed STOP.

Each optical signal transition will have at least one edge. A transition from 001 (Increase speed) to 100 (More Left), for example, will have both a rising edge and a falling edge. Typically rise and fall times will differ and this difference must be dealt with. Furthermore, noise generated by the H-bridges and motor commutation can make simple edge detection of the signal difficult. Low pass filters in the input stage could also reduce the noise, but a software approach is cheaper to implement and more likely to work in all conditions.

In order to identify the rising and falling edges of the signal among the noise, a multi-sample sliding window transition detection algorithm is proposed for the control circuit 40. This transition detection algorithm operates by looking for any transition, then accepting any additional transitions for a short duration as one single command change.

Figure 8:
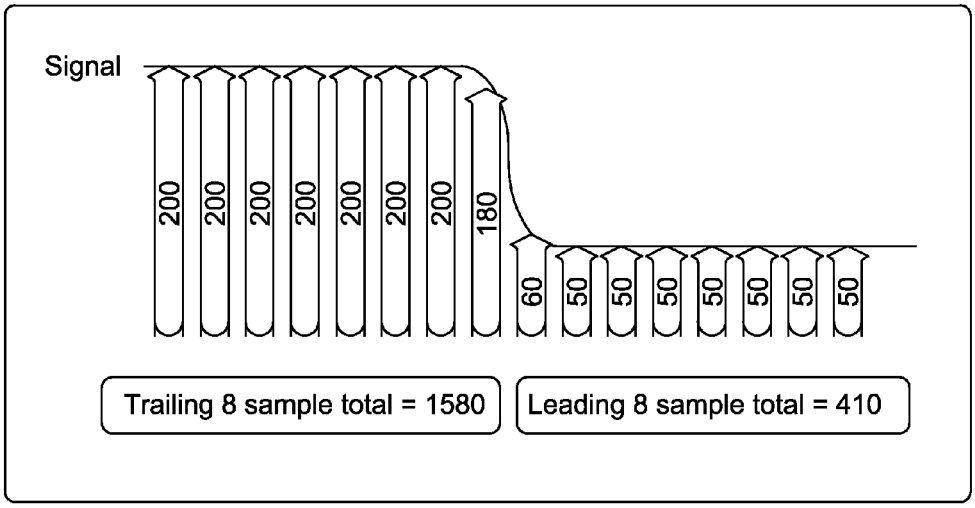
FIG. 8 depicts a transition detection algorithm as it would operate on an essentially noise-free signal.
Figure 9:
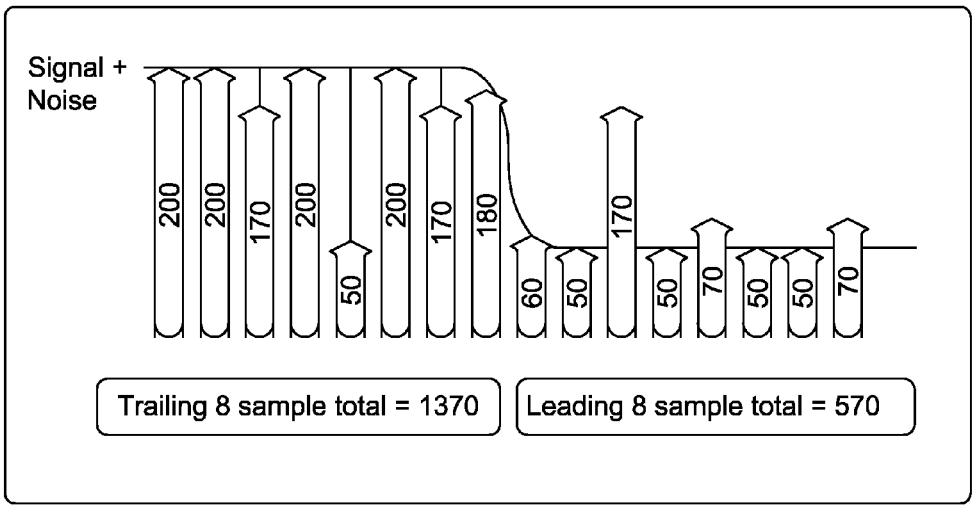
FIG. 9 depicts operation of the transition detection algorithm operating on a signal with noise.

Its operation is illustrated in FIGS. 8 and 9. Each new sample is added to an array of samples. The sum of the leading eight samples is compared to the sum of the trailing eight samples. When there is not a transition centered in the sliding window, the sum of each half will be approximately the same. Noise does not contribute significantly to the sum. When the window is centered on a transition, however, the two sums differ greatly regardless of the small noise.

In order to reduce workload in the microprocessor, it is suggested the sample window be embodied using a circular buffer to hold the samples and maintain a running total. When a sample is taken, these steps happen for each optical channel:

1. The oldest sample is subtracted from the trailing sum
2. The middle sample is subtracted from the leading sum and added to the trailing sum
3. The new sample replaces the old sample in the array and is added to the leading sum
4. Pointers to the new sample and middle sample are incremented and reset if necessary since part of a circular buffer.

The transition detection algorithm works for both ADC and GPIO input methods. Since the GPIO input is digital, the sums are much smaller (for a sixteen sample window, maximum of eight, minimum of zero), so the difference threshold can be changed accordingly. The threshold should be large enough so that noise does not cause any false transitions to be detected, but small enough so that transitions in small signals (low brightness) are detected.

With large signals, it is possible to detect a transition before it is centered in the sliding window. The difference threshold will continue to be exceeded for multiple consecutive samples. However, the algorithm is suggestedly configured to delay for a period after the first transition to capture any transitions on the other optical channels. The new command is executed after this delay has timed (or cycled) out, so these additional transition detections are essentially ignored.

In addition to the basic components depicted in FIG. 5, the control circuit hardware could include a manual ON/OFF switch as depicted in FIG. 1. As previously indicated, the system can be configured to disable both motors if no new commands are received in a timeout period (for example, about 250-400 milliseconds). The control system further can be configured to enter a deep sleep state after another, longer timeout period, for example, several seconds, without activity. This would allow the smart device 60 to take advantage of the no command timeout as a STOP command then send more commands once the toy 10 has returned to a known state.

An external RC circuit (not depicted) can optionally be provided to periodically wake the device 60 from deep sleep to check for optical activity, for example, transitions on the optical sensors. If the backlight is controlled to guarantee large signal changes, it may be possible to wait for simple digital transitions on the optical inputs in a low power mode. A two tiered standby and sleep is also possible, where the sleep is exited when the user pushes a separate button.

While the invention has been disclosed in the form of a robot/vehicle 10, it will be appreciated that a wide variety of toys including other types of vehicles, dolls and other figures, in particular, may be controlled in this way. Moreover, while one new optical coding system has been described and other known systems referred to, still other optical coding systems could be used with the inventive toy.

In addition, while propulsion road wheels have been disclosed as propulsion members of the toy, other controllable propulsion members like endless treads/tracks and air and water propellers are part of the invention. While movement of the toy has been disclosed as the humanly cognizable action, it will be appreciated that such movement is discernible by sight and possibly by sound and that other actions of the toy (apart from those of the smart device) responsive to either sense like light and/or sound generation by electrically operated devices (again other than the smart device) are considered part of the invention. It will be appreciated by those skilled in the art that changes could be made to the embodiments described above without departing from the broad inventive concept thereof and this invention is not limited to the particular embodiments disclosed.

The invention claimed is:

1. A toy configured to be controlled by a hand portable smart device having wireless communication network connection capability, a display screen and programming to generate optical control signals transmitted through the display screen, the toy comprising:

a main body;

a control circuit supported from the main body;

a holder supported from the main body and configured to receive and releasably support the smart device on the main body; and an optical signal receiver supported from the main body facing the display screen of the smart device held in the holder and operably connected with the control circuit;

the control circuit being configured to respond to optical control signals transmitted through the display screen of the smart device and detected by the optical signal receiver to control at least some operation of the toy.

2. The toy of claim 1 further comprising at least one electrically operated component operably connected with the control circuit, and wherein the control circuit is configured to operate the component to provide a humanly cognizable action in response to the optical control signals transmitted by the smart device and detected by the optical signal receiver.

3. The toy of claim 1 wherein the optical signal receiver includes at least two photo sensors located on the receiver so as to receive optical control signals from two locations on the display of the smart device positioned in the holder.

4. The toy of claim 1 wherein the optical signal receiver includes at least three photo sensors located on the receiver to receive optical control signals from three locations on the display of the smart device positioned in the holder.

5. The toy of claim 1 further comprising:

first and second propulsion members on either lateral side of the main body;

first and second propulsion motors supported by the main body respectively operably connected with the first and second propulsion members; and first and second independently operated motor driver circuits enabling separate and independent control of speeds of the first and second propulsion motors.

6. The toy of claim of claim 5 wherein the control circuit is configured to respond to common motor speed increase and decrease optical control signals and to each of the differential right turn and left turn motor speed optical control signals to simultaneously change speeds of both of the first and second propulsion motors.

7. The toy of claim 6 wherein the control circuit is configured to respond to each of the common motor speed increase and decrease optical control signals and to each of the differential right turn and left turn optical control signals by fractionally changing existing speeds of both of the first and second propulsion motors.

8. The toy of claim 7 wherein the control circuit is configured to respond to each of a differential right turn and a differential left turn optical control signal by fractionally changing existing speeds of both of the first and second propulsion motors equal amounts in opposite directions.

9. The toy of claim 5 wherein the first and second propulsion members are first and second road wheels supporting the main body for movement and respectively operably driven by the first and second propulsion motors.

10. The toy of claim 9 further comprising a third unpowered road wheel supporting the main body for movement.

11. A method of controlling an electrically operated toy having a main body, a control circuit, an optical signal receiver operably connected with the control circuit and supported from the main body, and a holder supported from the main body and configured to receive and releasably support a smart device having wireless communication network connection capability and further having a display screen positioned opposite the optical receiver, comprising the steps of:

releasably receiving in the holder, the hand portable smart device with the display screen positioned facing the optical signal receiver;

detecting with the optical receiver, an optical control signal from the display screen of the smart device; and operating the toy with the control circuit responding to the optical control signal detected through the optical receiver.

12. The method of claim 11 wherein the step of operating the toy comprises operating with the control circuit, an electrically powered component of the toy to provide a humanly cognizable action in response to the optical control signal transmitted through the display screen of the smart device.

13. The method of claim 11 wherein the detecting step comprises detecting with the optical receiver, a stream of consecutive optical control signals from the display screen of the smart device and wherein the step of operating the toy comprises operating the toy with the control circuit in response to the stream of optical control signals detected through the optical receiver.

14. The method of claim 13 wherein the toy is mobile and wherein the step of operating the toy comprises controlling movement of the toy with the control circuit in response to the detected stream of optical control signals.

15. The method of claim 14 wherein the toy has first and second propulsion motors and wherein the step of controlling movement of the toy comprises a step of controlling speeds of the first and second motors with the control circuit in response to the stream of optical control signals to control propulsion of the toy with the smart device.

16. The method of claim 15 wherein the speed controlling step further comprises a step of changing the speed of both of the first and second propulsion motors with the control circuit at the same time by a fractional amount in response to any one of the optical control signals of the stream.

17. The method of claim 16 wherein the changing speed step further comprises a step of responding with the control circuit to either of a differential right turn and a differential left turn detected optical control signal by simultaneously changing speeds of both of the first and second propulsion motors by the same fractional amount in opposite directions.

18. The method of claim 14 wherein the toy has first and second propulsion members and wherein the step of controlling movement of the toy comprises a step of controlling operating speed of the first and second propulsion members with the control circuit in response to the stream of optical control signals to maneuver the toy with the smart device.

19. The method of claim 14 wherein the controlling step further comprises identifying with the control circuit, transitions in the stream of optical control signals to identify separate consecutive control signals.

20. The method of claim 19 wherein the optical signal receiver includes a plurality of photo sensors operably connected with the control circuit and wherein the control circuit performs the steps of: looking for a transition from any of the photo sensors, delaying sufficiently to determine any stabilized new pattern of transitions from all of the looked at photo sensors and executing a command associated with a determined new optical control signal pattern.

* * * * *